US008724844B2

(12) United States Patent
Katz et al.

(10) Patent No.: US 8,724,844 B2
(45) Date of Patent: May 13, 2014

(54) HEAT DISSIPATING ACOUSTIC TRANSDUCER WITH MOUNTING MEANS

(76) Inventors: Robert Katz, Montreal (CA); Timothy Gladwin, Pakenham (CA)

( * ) Notice: Subject to any disclaimer, the term of this patent is extended or adjusted under 35 U.S.C. 154(b) by 0 days.

(21) Appl. No.: 13/702,838

(22) PCT Filed: Jun. 7, 2011

(86) PCT No.: PCT/IB2011/002560

§ 371 (c)(1),
(2), (4) Date: Dec. 7, 2012

(87) PCT Pub. No.: WO2012/014084

PCT Pub. Date: Feb. 2, 2012

(65) Prior Publication Data

US 2013/0083958 A1 Apr. 4, 2013

Related U.S. Application Data

(60) Provisional application No. 61/344,181, filed on Jun. 7, 2010, provisional application No. 61/455,222, filed on Oct. 16, 2010.

(51) Int. Cl.
*H04R 1/00* (2006.01)

(52) U.S. Cl.
USPC ..... 381/412; 381/397

(58) Field of Classification Search
USPC ..... 381/333, 152, 388, 396–433; 181/171–172
See application file for complete search history.

(56) References Cited

U.S. PATENT DOCUMENTS

| | | | | |
|---|---|---|---|---|
| 6,618,487 | B1 * | 9/2003 | Azima et al. | 381/152 |
| 7,218,745 | B2 * | 5/2007 | McConnell et al. | 381/302 |
| 2005/0041831 | A1 * | 2/2005 | Stiles et al. | 381/412 |
| 2006/0013417 | A1 * | 1/2006 | Bailey et al. | 381/152 |
| 2007/0160257 | A1 * | 7/2007 | Stiles | 381/421 |

* cited by examiner

*Primary Examiner* — Brian Ensey
*Assistant Examiner* — Norman Yu
(74) *Attorney, Agent, or Firm* — Camille L. Urban; David M. Breiner

(57) ABSTRACT

The inertial transducer comprises a foot, a modular key, at least one suspension means having at least three contact points, and heat dissipation means comprising multiple heat transfer points. The foot alternatively includes an opening or a cap. The cap may be frangible. Preferably, the foot includes a cylindrical wall that extends within the inertial transducer and the foot's lower surface is coplaner with the lower surface of a housing of the transducer, thereby reducing stack height. The cylindrical wall may or may not be threaded and may accept a shaft from a receiving apparatus used to associate the transducer with a substrate.

30 Claims, 7 Drawing Sheets

HEAT DISSIPATING ACOUSTIC TRANSDUCER WITH MOUNTING MEANS

PRIORITY CLAIM

This is a nonprovisional patent filing claiming the benefit of provisional patent application Ser. No. 61/344,181 titled Heat Dissipating Acoustic Means and filed on Jun. 7, 2010, and of provisional patent application Ser. No. 61/455,222 titled Heat Dissipating Transducer with Mounting Means filed Oct. 16, 2010.

FIELD OF THE INVENTION

The present invention relates generally to electrodynamic, acoustic actuators capable of converting energy between electrical and mechanical form and, more particularly, to a momentum or inertial type acoustic actuator that utilizes a multi-component suspension for alignment of the internal structures including the moving coil, and novel heat dissipation and mounting means improving performance and ease of use. For the purposes of this patent, a momentum or inertial type acoustic actuator may also be referred to as an inertial type voice coil actuator, or an inertial type momentum driver.

BACKGROUND OF INVENTION

Momentum type transducers have been utilized to input mechanical energy into a substrate in order to have the substrate move and function as a distributed mode loudspeaker. U.S. Patent to Vincent et al. U.S. Pat. No. 7,386,144 has taught that an inertial type acoustic transducer can do work of this nature using an output disc mechanically attached to a substrate via a receiver using mechanically interlocking tab on the output disc and the receiver. U.S. Pat. No. 5,335,284 to Lemons for Coneless, No-Moving-Part transducer mechanically couples the transducer to the substrate and teaches of a loudspeaker affixed to a wall via a protruding screw forming part of the loudspeaker and which screw, screws into the substrate. Oser U.S. Pat. No. 7,418,108 also teaches of an inertial type transducer. Equally User references a threaded stud protruding from the voice coil actuator or inertial type momentum driver which stud is used as a part of the mounting means or means to affix the transducer to the substrate which negatively affects stack up height of the invention.

As the voice coil actuator or inertial type momentum driver all use varieties of magnetic motors, additional power to perform work is an advantage. Power typically does require the use of magnets which can vary in their capacity to do work by way of their formulation, materials and manufacture. As novel aspects of the art cited herein does include integrating the inertial type audio transducer described into other products, within walls and generally in closed locations, high powered magnets such as neodymium may be considered but are not exclusive to this patent as many other magnet formats may be used such as but not limited to ceramic type magnets. Magnet materials are however sensitive to temperature and would have a propensity to demagnetize or loose efficiency should temperatures rise in the general area of the magnet as a result of electro mechanical work being done. Heat dissipation then becomes a problem as the voice coil windings may get very hot, spread this heat into the magnet structures and demagnetize the magnet material producing a detrimental effect. High heat can even destroy the voice coil and its windings.

Heat dissipation becomes a critical factor. A novel aspect of this invention is to draw heat out of the affected areas of the inertial type acoustic transducer. Using materials and designs to create a path for heat to be conducted and convected away from the voice coil including its windings, magnets and other heat sensitive components and materials, thus augmenting reliability. This permits compact designs to be engendered without risk where the compactness can create new novel applications as well as improving the performance of the acoustic transducer or voice coil actuator when used in constrained or closed spaces.

Generating a magnet motor which is compact and has a high power output know as the BL product in relationship to its size would be advantageous. Power is being described as product of the current, I, length of coil wire, L and flux density, B so that $F=iL \otimes B$. Part of the novelty described herein relates to the size of power density of the magnetic motor used. Power will then translate to more efficient transfer of mechanical energy as well as better fidelity when the transducer is used in association with a substrate to reproduce desired audio content.

Associating the inertial or momentum type voice coil transducer with the correct substrate is also at times non trivial. Substrates can range from a great many different materials. Creating a means to reliably and mechanically soundly the voice coil transducer or inertial type momentum driver with a given material is also important. Materials that can be presented are, by way of example and not for limitation, glass, wood, fiberglass, wall board, metal, ceiling tiles. Ferrous metal surfaces can be commonly found in the environments in wall cladding and modular wall systems or other product housings which, again, are by way of example, signage which would benefit from audio content to improve the quality of communication of specific messages, for example. These substrates or soundboards would otherwise work well with an inertial type acoustic transducer but other problems arise.

These additional challenges relate to the magnetic motor and its internal components which must be arranged to minimize or reduce an externalized magnetic flux field. External magnetic flux would shift the internal components forming the magnetic motor, voice coil, voice coil windings, magnetic gap and motor suspension out of tolerance and optimized placement. This, in turn, would negatively affect the performance of the transducer. It is therefore important for the magnetic circuit envisaged in the present invention to not produce a significant stray magnetic flux field out of the magnetic motor as it would draw the stated components towards to steel substrate and out of position. This would have a direct negative repercussion with regards to sound quality. A magnetic motor forming part of the inertial type acoustics transducer having an internalized flux field is desired an is taught in this invention.

The present invention teaches a novel modular system to create an associative means which mechanically couples the inertial type voice coil actuator using a systematic approach to a variety of substrates and retaining the mechanical parameters for sound propagation and transfer of considerable fidelity. U.S. Publication No. 20060126886 A1 teaches a protruding elongated shaft from an acoustic actuator which couples with another protruding actuator stud protruding from a transducer foot. This produces an excessive stack up height which is a disadvantage for the objective of using the transducer within walls or within products. A novel means of reducing stack height will be presented in this invention. Additionally the system will accommodate a variety of substrates using a dedicated mounting means and providing for additional modalities for affixing the transducer to various substrates without significantly adding stack up height. In a novel fashion, the dedicated mounting means described in this invention will provide for optimized heat dissipation as well.

Retaining axial alignment of the voice coil relative to the magnetic gap in the magnetic motor structure is equally challenging. Vincent et al. U.S. Pat. No. 7,386,144 teaches a double suspension. In the present invention a novel means is introduced to create a suspension means bridging and controlling the axial alignment between the voice coil and associated voice coil wire windings to the magnetic motor, and magnetic motor to housing thereby creating the desired control between all components and hence improving sound quality and eliminating distortion by way of part interference or misalignment. Additionally other means are used to further improve part separation and optimal sound quality using ferro fluids within the magnetic gap.

Those skilled in the art will recognize that improvement in the power handling can be realized by the addition of a magnetic fluid in the form of low viscosity oil, having microscopic ferrous particles such as magnetite, homogeneously suspended in the fluid. The oil-magnetic emulsion is attracted to and held in the magnetic field within the magnetic gap by reason of the magnetic flux across this gap. The magnetic particles hold the liquid phase of the oil within the gap. The viscous magnetic fluid provides a heat dissipating mechanism and a radial restoring force when the voice coil is radially displaced. The restoring force is a result of an unbalanced magnetic force in the fluid when the fluid is not symmetrically displaced within the magnetic gap and coil former. The radial restoring force is typically sufficient to support the mass of the magnetic circuit when its axis is parallel to a horizontal orientation. In the event of substantially larger radial forces that will overcome the radial restoring force of the viscous magnetic fluid, the antifriction bearing acts as a back-up bearing for the voice coil former.

SUMMARY OF THE INVENTION

It is an object of this invention to invent an novel means to create a variable system to mount an inertial type acoustic transducer or inertial type momentum driver to numerous substrates acting as soundboards.

It is further an object of this invention to minimize addition to overall stack up height of the transducer so as to permit installation in to space restricted and enclosed areas.

It is further an object of this invention to provide a novel means to permit the dissipation of heat generated by the electro mechanical motor found in the voice coil actuator or inertial type momentum driver to improve reliability and maintain a high level of consistent performance.

It is an object of this invention to provide means to mechanically associate the voice coil actuator or inertial type momentum driver with a wide variety of substrates so as to improve the ability for the voice coil actuator or inertial type momentum driver to be installed into a great many environments with varied installation requirements.

It is also an object of this invention to provide a novel means to utilize a novel suspension means to hold the magnet motor in alignment with the voice coil in such a way that provides multiple suspension and contact points.

It is also an object of this invention to provide a high energy magnet structure which is reduced in volume so as to fit the voice coil actuator or inertial type momentum driver into small spaces, walls and other products.

It is further an object of this invention to provide a means for heat dissipation of the voice coil and its windings, magnet motor and other heat sensitive components and materials so as to improve efficiency, fidelity and reliability.

It is further an object of this invention to create a magnet motor which has negligible stray flux so the transducer can be mounted in direct association with steel soundboards, or soundboards using steel or other ferrous materials in their general vicinity.

It is also an object of this invention to provide a novel means to ensure co-axial alignment of the voice coil in the magnetic air gap of the magnetic motor.

It is yet another object of this invention to provide a means to improve acoustic efficiency of the transducer and reduce noise and distortion of the voice coil actuator or inertial type momentum driver.

A cone speaker of the present invention includes the additional assembly of a basket assembly, cone diaphragm, suspension surround between the associated basket and cone, spider suspension between the cone and the basket, dust cap covering coil and the cone. Those skilled in the art will recognize that other components and materials may be utilized as well.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DETAILED DESCRIPTION OF PREFERRED EMBODIMENT

Figure 1A:
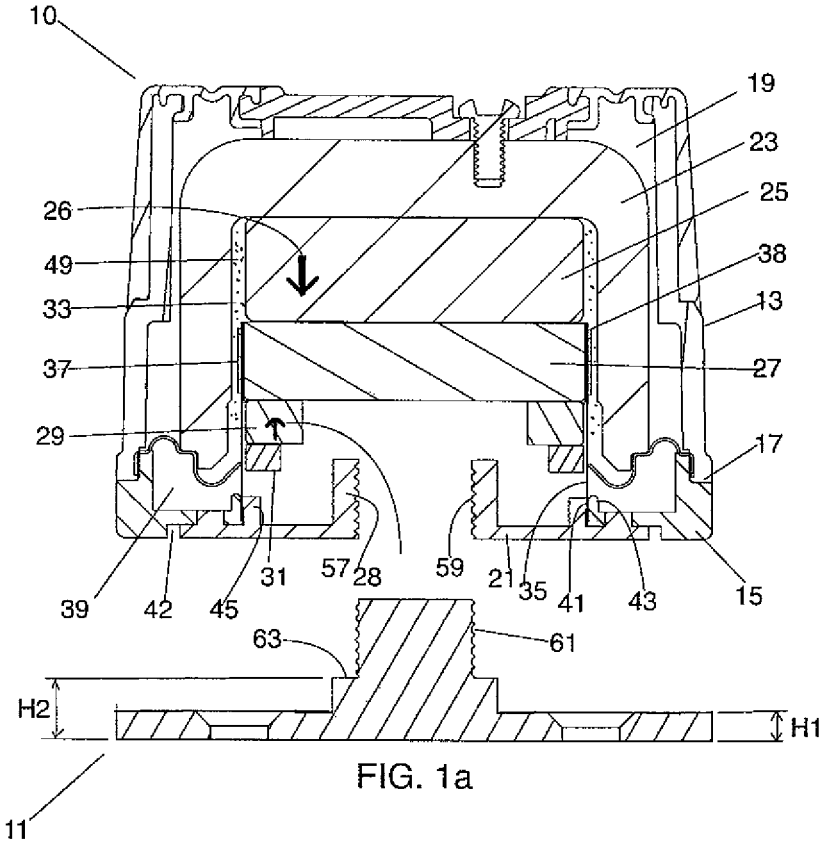
FIG. 1*a* is a cross sectional view of the momentum type transducer and receiver means of the present invention.

A cross-sectional view of an embodiment of the present invention is illustrated in FIG. 1*a*. The illustration presents the present invention of the novel inertial type acoustics transducer 10 and mounting receiver means both as a cross section of a body of revolution. The transducer is characterized by a top housing part 13 and a lower foot 15. The foot 15 and the upper housing 13 are joined by an "L" shaped lap joint 17 where both parts exhibit a interlocking overlap. This joint can be accomplished many ways as would be evident to someone skilled in the art and could include but is not limited to screw assembly, adhesive assembly or ultrasonic assembly. A modular assembly key 21 is affixed to foot 15. This modular assembly key 21 may vary in its features and characteristics to present novel modular means to permit securement of the transducer 10 to various substrates as well as provide means for heat dissipation and other features as will be described herein. The electro magnetic motor assembly 19 preferably comprises a cup shaped yoke 23, and a bottom magnet 25 with south to north polarity shown by arrow 26. Magnet 25 would ideally be a neodymium high powered magnet to reduce volume of the transducer but may be a ceramic type magnet or other type of magnet. In one acceptable embodiment of the magnet motor, a ferrous steel front plate disc 27 is assembled to magnet 25. And a second ring shaped magnet 29 who's south to north polarity is shown by arrow 28 is then assembled to metal disc 27. A ferrous metal ring 31 may optionally be assembled to magnet 29. Yoke 23, front plate disc 27 and ring 31 may use a 1008 grade steel or other like material. The electromagnetic motor 19 as described herein is a preferred embodiment and only serves to illustrate principles of the invention described by this patent. Anyone skilled in the art would be able to modify the design of this magnetic motor and still establish the same novel aspects of this invention. The desired attributes of the preferred embodiment herein comprise containing generally all magnetic flux in the magnetic circuit with only negligible, if any, stray magnetic flux external to the magnetic circuit. This would represent an ideal condition but is not an essential part of this invention.

A magnetic air gap 33 allows a voice coil former 35 to be inserted. Preferably, a plurality of conductive windings 37 are present on the voice coil and have positive and negative leads that enter into a chamber 39 in order to make connection to wire leads that exit the transducer 10 housing which shall be shown in FIG. 2. The Front plate disc 27 uses a copper shorting ring 38 which is either assembled to front plate disc 27 or plated thereto. The shorting ring 38 enhances higher frequency sounds as reproduced by the transducer 10.

Figure 1B:
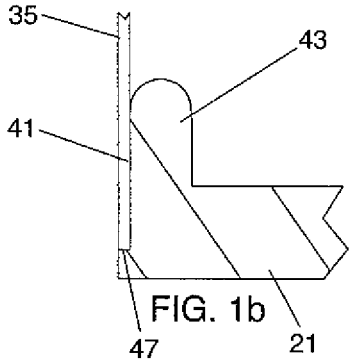
FIG. 1*b* is a cross sectional detail view of a portion of the momentum type transducer in FIG. 1*a;*

Now referring to FIG. 1*b*, which provides a detail of the joint between the foot 15 and the modular key 21, the voice coil former 35 is assembled to the foot 15 and is coaxially and assembled to an annular ring 43 found on foot 15 in contact with vertical wall 41 of foot 21. A small abutment 47 helps seat and align the axial orientation of the voice coil former 35 but is not essential to this invention. The voice coil former may simply be aligned on the vertical wall 41 to the desired height manually and with assembly tools. During assembly, standard processes known in the industry may be used to further align the voice coil former by way of using such a device commonly known as a "centering tool" (not shown).

Referring now back to FIG. 1*a*, another annular ring 45 forms part of modular key 21. This annular ring 45 is affixed to voice coil former 35 by means commonly used which may include adhesive bonding. If adhesive bonding is used, a thermally conductive adhesive is not required but is preferred as it will conduct heat away form the voice coil. A ferro fluid 49 is used in the magnetic gap 33 to permit better centering of the voice coil 35 and voice coil windings 37. As work is done, the voice coil windings 37 will generate heat. If uncontrolled, such heat can be destructive. Ferro fluid 49 has a secondary function of transmitting some heat produced by the coil windings 37 to the magnet motor 19. The voice coil former 35 is ideally fabricated of aluminum or other thermally conductive material but such is not an absolute requirement. Aluminum has better thermal transmission properties as compared to other voice coil former materials such as but not limited to "Kapton" or other polymer based voice coil formers although these may also be employed with a degree of success. Heat is conducted through the voice coil former 35 and through the adhesives used if such adhesives are heat conductive into modular key 21 and foot 15. Materials used for the modular key 21 and foot 15 may also be made of thermally conductive material such as but not limited to aluminum. Heat can then be absorbed and may be conducted by the thermally conductive materials acting as a heat bridge to conduct and convect heat from foot 15 and modular key 21. Additionally, radially oriented heat sink fins can be added to the foot 15 generally at its perimeter (not shown) to help with said heat dissipation.

Figure 2:
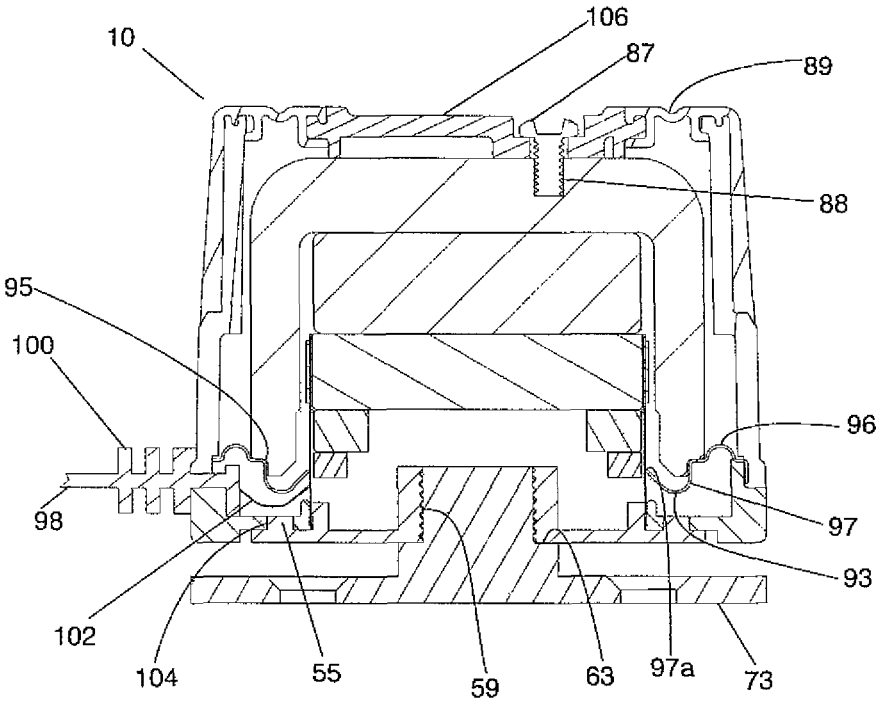
FIG. 2 is a cross section view of the assembled momentum type transducer and receiver means for FIG. 1*a;*

Referring to FIG. 2, once the voice coil 35 has been assembled to the foot 15 and within the transducer 10 assembly, the centering tool is removed having accomplished its task of coaxially aligning the voice coil former 35 within the air gap 33. As the foot 15 is assembled to voice coil former 35, thermally conductive adhesives are recommended albeit not required. Once the magnet motor beings its work, the shear forces between the voice coil former 35 and the vertical wall 41 of foot 15 can be high. The assembly of modular key 21 and more specifically the association of annular ring 45 with the inside surface of voice coil former 35 strengthens the assembly. Modular key 21 can be assembled to foot 15 by several means such as screws, adhesives or other like means including any combination thereof. In a preferred embodiment, a plurality of pins 55 fit into one of a plurality of holes 104 to provide alignment and stability between modular key 21 and foot 15. The pin can be replaced by a screw or other fastening means as would be known to someone skilled in the art.

Referring to FIGS. 4*a* to 4*c* and FIG. 2, the modular key is illustrated. The exterior vertical wall of ring 45 serves to support and secure the voice coil 35 to the modular key. One or a plurality of locating pins 55 or screws may serve to guide the modular key into an opening 42 of the foot 15. The opening 42 preferably has a depth selected so that upon assembly, the stack height is minimized. Preferably the depth is such that once the modular key 21 is assembled to the foot 15, a bottom surface 61 of the modular key 21 is essentially coplanar with the base of the foot 15. Alternatively, the bottom surface 61 may be slightly recessed in relation to the foot 15 to permit heat to radiate more effectively to the outside edge where a temperature differential may be greater and to vary acoustic output if desired. One or more stiffening ribs 51 may be used to structure the modular key 21. An outside edge 53 of the modular key 21 is shown to be square in shape, and matches a receiving opening 42 for the modular key 21 in the foot 15. This geometric shape, coupled with one or a plurality of the registration pins 55 impede rotation of the modular key 21 in the opening 42. Screws would have the same effect. The shape may vary greatly to a hexagon shape or other shape to impede rotation once assembled. In some embodiments, the bottom surface 61 of the key and the base of the foot are not flat but, instead, are of like curvature.

A threaded cylinder 57 of the foot 15 is concentric with the center axis of rotation of the transducer 10. The threaded cylinder 57 is made to penetrate the transducer interior space and does not add to the stack up height of the transducer 10. Cylinder 57 is preferably, but not necessarily, characterized by an internal thread 59. The height of cylinder 57 of the modular key 21 is such that it will not interfere with any part of the magnet structure 19 once assembled to transducer 10 and when transducer 10 is functioning. Also referring to FIG. 1*a*, the mounting receiver apparatus 11 is characterized by a threaded shaft 61 which is concentric with a centerline axis of the receiver apparatus 11. At the base of the shaft, a shoulder 63 acts as an abutment and thermal bridge. Also referring to FIG. 2, the threaded shaft 61 is of a like thread size to internal thread 59. The sealing achieved by turning the shaft 61 into the internal thread 59 may be enhanced by using thread locking glue to ensure a permanent assembly. Once transducer 10 is mounted on receiving apparatus 11, the shoulder 63 would abut the bottom surface of modular key 21. It should be noted that the shoulder 63 when functioning as a thermal bridge may be increased in size, thereby creating a large contact surface between it and the outside surface of the modular key 61, thus improving heat transfer from the transducer 10 to the receiver apparatus 11 and ultimately into the substrate.

Figure 3:
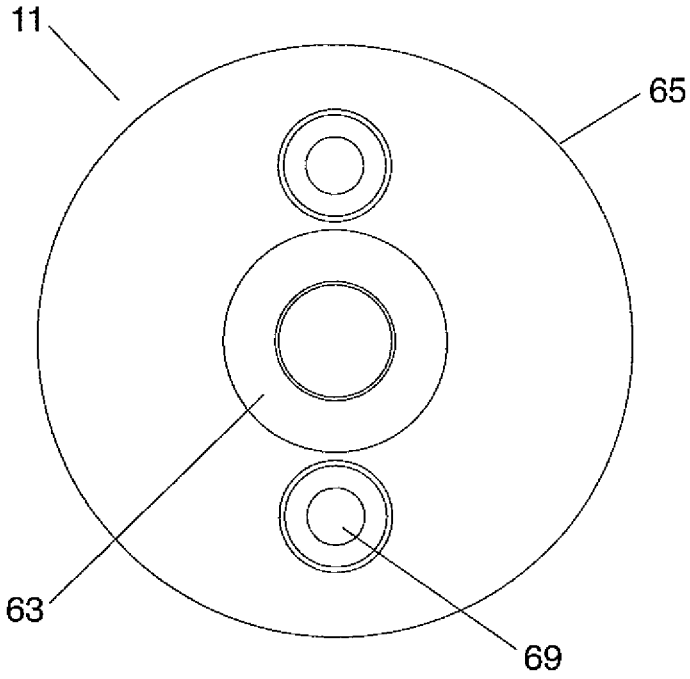
FIG. 3 is top view of a receiver means employed in an embodiment of the present invention.
Figure 4A:
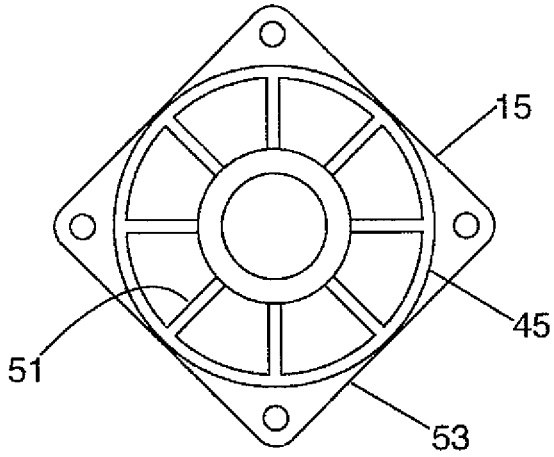
FIGS. 4*a*, 4*b*, 4*c* are detailed views of a modular assembly key used in a preferred embodiment.
Figure 4B:
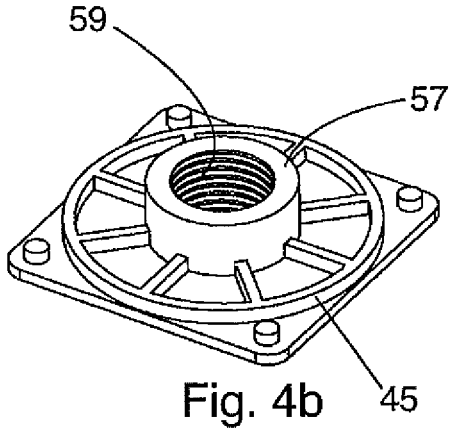
Figure 4C:
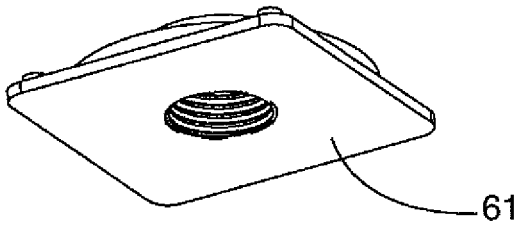

Referring to FIG. 2 and FIG. 3, the outer perimeter 65 of the receiver apparatus 11 is shown to be round but may be shaped otherwise. The receiver apparatus may be used to mount the transducer 10 to various substrates. A base 73 of the receiver apparatus 11 is substantially flat and may be adhesively bonded to a substrate, or may alternatively be secured to a substrate by way of one or multiple screw holes 69, or may be assembled to a substrate using other means to have the receiver apparatus 11 solidly affixed to the desired substrate. Combinations of these described securing means, or others not mentioned but familiar to those skilled in the art may equally be used. The size of the base 73 of the receiver apparatus 11 should be large enough to permit secure attachment and to be effective in transmitting mechanical energy produced by the transducer 10 to a given substrate.

Referring to FIG. 1*a*, H1 shows a height of the main surface of the receiver apparatus. H2 shows the height of the shoulder 63, which height can be reduced to a minimum. H1 is to be made a minimum to limit stack up height of the transducer 10 and receiver apparatus 11 stack up height once assembled. H1 is less then H2 so mechanical energy produced by the transducer 10 passes directly through the transducer 10 through its connection with the shaft 61 and the base of the modular key 21 to the shoulder 63, and then into the receiver apparatus to the substrate. This system is to provide minimal stack up height allowing the transducer 10 to be installed in many volume and height restrained installations.

During normal functioning of the transducer 10, heat will be produced by the voice coil windings 37. As the voice coil former 35 is fabricated of heat conductive material the path of heat will flow form it to the modular key 21 and would then follow a path to the threaded cylinder 57. Intimate contact between the internal thread 59 and threaded stud 61 as well as thermal bridging between the shoulder 63 of the apparatus 11 through the base of the modular key 21 would provide a thermal bridge for heat to escape out to the receiver apparatus 11, which part would then be able to function to further enhance heat dissipation of the transducer 10 and receiver apparatus 11 heat dissipation system. As the threaded post 61 may be secured to mating threads 59 by way of thread locking material, this material would further enhance the thermal conduction of heat passing from the transducer 10 to the receiver apparatus 11. Alternatively, the threaded post 61 and mating threads 59 may not be present and friction fit or adhesive or other means may be employed to secure the two relative to one another.

Figure 5A:
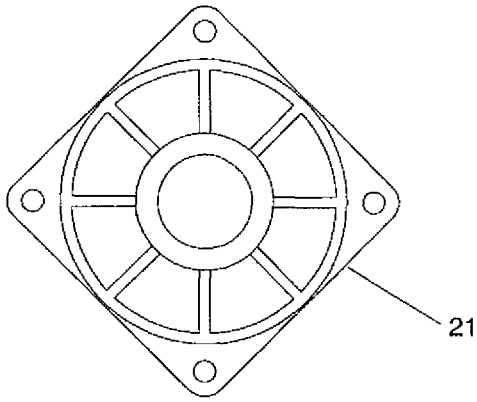
FIGS. 5*a*, 5*b*, 5*c* are detailed views of a second modular assembly key used in a preferred embodiment.
Figure 5B:
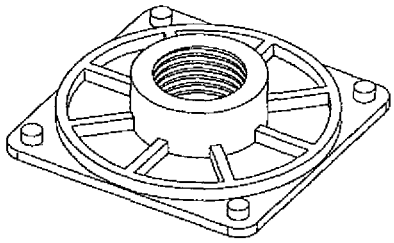
Figure 5C:
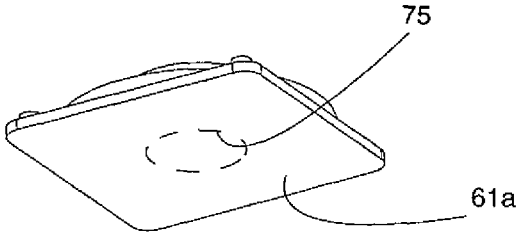

Referring to FIGS. 5*a* to 5*c*, the modular key may be fabricated having a fully filled in bottom surface 61*a*. This may be employed if the transducer 10 was to be affixed to a substrate where the receiving apparatus 11 would not be beneficial. An example of this would be to mount the transducer 10 on to a glass surface using for example, using double sided adhesive tape. Having the base fully covered would impede stray material from entering the transducer. Modular key 21 would in this embodiment serve as a cap. A disc 75 forming part of bottom surface 61*a* may be frangibly affixed to the modular key 21 such that if needed, the frangible disc 75 may be removed exposing the internal thread 59, if it is present; this permits optional mounting of the transducer 10 onto the receiving apparatus 11. Alternatively the disc surface 75 may be machined or otherwise removed from the modular key 21 so as to create access to the internal thread 59. To further illustrate the need when associating the transducer 10 to a substrate directly, a person skilled in the art could conceive of the foot 15 and the modular key 21 being formed of a single part.

Figure 6:
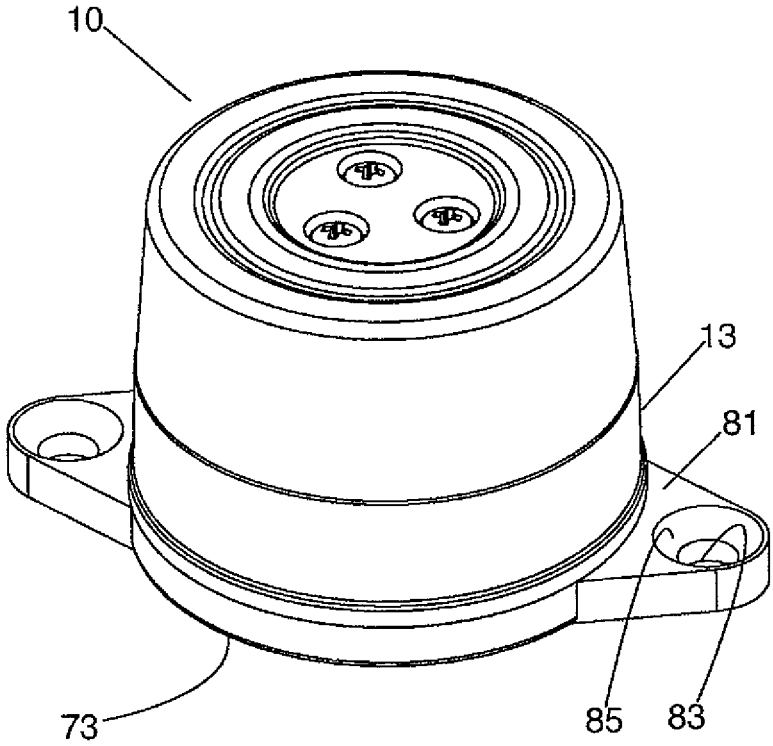
FIG. 6 is a perspective view of the transducer of the present invention without receiver means.
Figure 7:
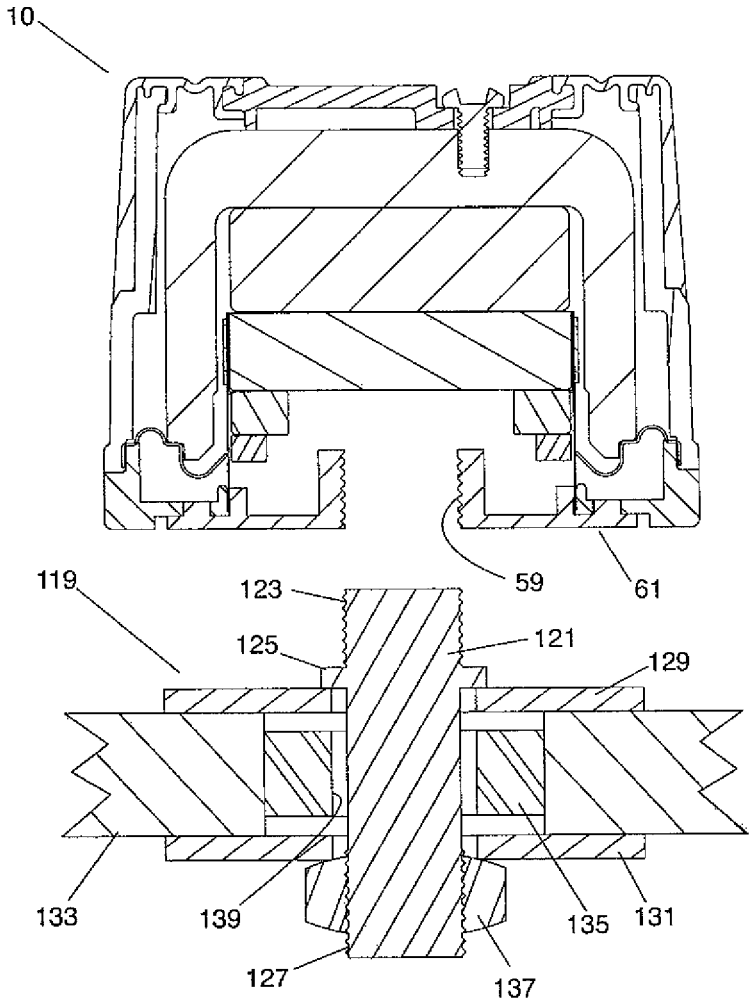
FIG. 7 is a cross section view of the assembled momentum type transducer of the present invention and alternative receiver means.

FIG. 6 illustrates an alternate preferred embodiment of transducer 10 whereby at least one securement flange 81 is cantilevered off of foot 15. Flange 81 is characterized by hole 83 permitting a screw or other fastener to hold it to a substrate. Countersunk surface 85 permits lower profile countersunk screws to be used. In addition to securement to a substrate by a fastener, the transducer 10 may also use adhesives on base 73. Alternatively, the transducer 10 of FIG. 6 may not include any flanges 81 and/or may simply be adhesively associated with a substrate.

Referring to FIGS. 1 and 2, the magnetic motor 19 is secured into the upper housing 13 by way of a double suspension which controls the axial alignment of the magnetic motor 19 to the voice coil former 35. At least one screw 87 holds the magnetic motor 19 to the housing 13 via threaded hole 88 in the yoke 23. It should be noted that the depth of the screw hole 88 is preferably shallow to avoid impedance of magnetic flux within the yoke 23. Shown in a revolved section are the axial spring 89 bridges, the vertical wall of the upper housing 13, and the upper surface of the housing 106. The spring element 89 may be of an elastomeric material, metal spring or other compliant means to provide controlled axial displacement only. An axially compliant spider suspension 96 is located at the distal end of the magnetic motor 19. This suspension means maintains axial alignment between the following 3 elements, the housing 13, the distal end of the magnetic motor 19 and the voice coil former 35. The purpose of these three points of contact is to impede the magnetic structure 19 including its magnetic air gap 33, from cocking about the voice coil former 35. The outer perimeter 91 of suspension means 97 is fixedly engaged in joint 17. At the midpoint of the suspension means 96, it is affixed adhesively or otherwise to the notch 95 in yoke 23. The third point of suspension is at the inner diameter 97*a* of the suspension means 97, which is generally adhesively affixed to the voice coil former 35. Rolls 96 and 99 provide for movement during axial compliance and axial reciprocating movement of the magnetic motor 19 within the transducer 10.

Wire 98 feeds the transducer 10 an electrical signal. The wire enters the cavity 39 by way of strain relief 100. Positive and negative wire leads 102 connect to positive and negative wire leads forming part of voice coil conductive windings 37.

What we claim is:

1. An inertial type acoustic transducer comprising:

an electromagnetic motor assembly including at least one yoke and at least one magnet, components of the electromagnetic motor assembly being stacked and leaving a small magnetic gap bounded by an inner wall of the yoke;

a voice coil on a voice coil former, the voice coil being positioned at least partially in the magnetic gap; and a first suspension comprised of at least one element, the first suspension configured to connect the voice coil former to the electromagnetic motor assembly and connect the electromagnetic motor assembly to at least one of a housing and a foot structure.

2. The inertial type acoustic transducer of claim 1 wherein the electromagnetic motor assembly further comprises a top plate.

3. The inertial type acoustic transducer of claim 1 further comprising:

the housing, the housing having an inside surface and a second suspension, wherein the second suspension associates the inside surface with the electromagnetic motor assembly.

4. The inertial type acoustic transducer of claim 3 wherein the inside surface of the housing includes a compliant material allowing for axial displacement of the electromagnetic motor assembly.

5. The inertial type acoustic transducer of claim 4 wherein the compliant material is also resilient.

6. The inertial transducer of claim 3, further comprising:

the foot structure, wherein the foot structure generally covers the housing, the foot structure comprising an opening, an inside surface, and an outer surface.

7. The inertial transducer of claim 6 wherein the opening includes a diameter generally concentric with and substantially equal to a diameter of the voice coil former.

8. The inertial transducer of claim 3 further comprising:

the foot structure, wherein the foot structure generally covers the housing, the foot structure including an inside surface, an outer surface, and a lower surface, the inside surface including a cylindrically shaped wall extending inward toward the electromagnetic motor assembly to minimize height.

9. The inertial transducer of claim 8 wherein the lower surface is associated with a soundboard.

10. The inertial transducer of claim 6 or 8 wherein the foot structure comprises at least one cantilevered tab from its perimeter.

11. The inertial transducer of claim 6 wherein the voice coil former and the inside surface of the foot structure are associated.

12. The inertial transducer of claim 6 wherein the foot structure includes a cover generally coplanar to the outer surface.

13. The inertial transducer of claim 12 wherein the cover includes an annular ring having internal threads.

14. The inertial transducer of claim 12 wherein the foot structure further includes at least one hole and the cover further includes at least one pin to register with the at least one hole to impede movement of the cover.

15. The inertial transducer of claim 13 wherein the cover includes an opening in its surface.

16. The inertial transducer of claim 15 wherein the opening includes threads.

17. The inertial transducer of claim 15 further comprising:

a receiver apparatus having a base and a protruding shaft generally at its center over which the opening in said cover is positioned.

18. The inertial transducer of claim 7 wherein the foot structure further includes threads and the inertial transducer further includes a receiver apparatus having a base and a protruding shaft at its center over which the opening of the foot is positioned.

19. The inertial transducer of claim 17 or 18 wherein the base comprises a flat lower surface capable of being mounted onto a substrate.

20. The inertial transducer of claim 18 wherein the base comprises a flat lower surface capable of being associated with a substrate.

21. The inertial transducer of claim 12 further comprising:

a receiver mounting apparatus including a shaft affixed to and protruding from a substrate and positioned within and associated with the opening of the foot structure.

22. The inertial transducer of claim 1, wherein the first suspension has at least three contact points.

23. The inertial transducer of claim of 22 wherein said at least three contact points comprise a contact point between the voice coil former and at least one element of the first suspension, a contact point between the electromagnetic motor assembly and at least one element of the first suspension, a contact point between the housing and at least one element of the first suspension, and a contact point between the foot structure and at least one element of the first suspension.

24. The inertial transducer of claim of 23 further comprising means to dissipate heat including at least two contacts selected from the group consisting of:

a contact between the electromagnetic motor assembly and a ferro fluid in the small magnetic gap, a contact between a shoulder of a receiving apparatus and a cylinder, a contact between the voice coil former and the foot structure, a contact between the foot structure and the shaft, a contact between the foot structure and a substrate, a contact between the foot structure and a cap, a contact between the foot structure and the shoulder, a contact between the electromagnetic motor assembly and the voice coil former, a contact between a cap and the shaft, a contact between the cap and the shoulder, a contact between the voice coil former and the cap, a contact between the voice coil and the electromagnetic motor assembly, a contact between the ferro fluid and the voice coil, and a contact between the voice coil and the voice coil former.

25. The inertial transducer of claim 6 or 8 wherein the first suspension element has at least two contact points selected from the group consisting of a contact between the voice coil former and the first suspension element, a contact between the electromagnetic motor assembly and the first suspension element, a contact between the housing and the first suspension element, and a contact between and the foot structure and the first suspension element.

26. The inertial transducer of claim 8, 12 or 17 further comprising means for dissipating heat via its structure.

27. The inertial transducer of claim 26 wherein means for dissipating heat comprise heat sink fin structures associated with at least one of the group consisting of the foot, receiver apparatus, and housing.

28. The inertial transducer of claim 26 wherein means for dissipating heat comprise said housing at least partially comprised of metallic material.

29. The inertial transducer of claim 6 or 8, wherein the first and second suspension elements together provide at least three points of contact for heat dissipation selected from the group consisting of:

a contact between the electromagnetic motor assembly and the housing, a contact between the electromagnetic motor assembly and a ferro fluid, a contact between a shoulder and a cylinder, a contact between the voice coil former and the foot structure, a contact between the foot structure and the shaft, a contact between the foot structure and a substrate, a contact between the foot structure and a cap, a contact between the foot structure and the shoulder, a contact between the first suspension element and a ferro fluid, a contact between the cap and the shaft, a contact between the cap and the shoulder, a contact between the voice coil former and the cap, a contact between the voice coil and the electromagnetic motor assembly, a contact between a ferro fluid and a voice coil, a contact between the voice coil and the voice coil former, and a contact between the electromagnetic motor assembly and the voice coil.

30. The inertial transducer of claim 3 wherein stray magnetic flux is controlled through placement of at least one of the top plate and the magnet within the yoke to focus the flux within the gap.

* * * * *